US005666148A

United States Patent [19]

Kitamura

[11] Patent Number: 5,666,148

[45] Date of Patent: Sep. 9, 1997

[54] IMAGE FORMING APPARATUS WITH AN ELECTRODE UNIT HAVING PLURAL ELECTRODES

[75] Inventor: Tetsuya Kitamura, Gifu, Japan

[73] Assignee: Brother Kogyo Kabushiki Kaisha, Nagoya, Japan

[21] Appl. No.: 264,943

[22] Filed: Jun. 24, 1994

[30] Foreign Application Priority Data

Jul. 28, 1993 [JP] Japan ..... 5-186111

[51] Int. Cl.[6] ..... B41J 2/385; G03G 9/08

[52] U.S. Cl. ..... 347/158

[58] Field of Search ..... 347/55, 151, 120, 347/14; 355/246, 262, 247, 261

[56] References Cited

U.S. PATENT DOCUMENTS 3,689,935 9/1972 Pressman et al. ..... 347/55
5,036,341 7/1991 Larsson ..... 347/55
5,128,695 7/1992 Maeda ..... 347/55
5,153,611 10/1992 Kokado et al. ..... 347/55
5,283,594 2/1994 Iwao ..... 347/55
5,402,158 3/1995 Larson ..... 347/151

*Primary Examiner*—Benjamin R. Fuller
*Assistant Examiner*—L. Anderson
*Attorney, Agent, or Firm*—Oliff & Berridge

[57] ABSTRACT

An image forming apparatus has an aperture electrode member formed of a polyimide insulating sheet of preferably 25 μm thickness, control electrodes of preferably 1 μm thickness formed on the upper surface of the insulating sheet, and five apertures each of which has an aperture diameter of preferably 40 μm formed in each control electrode. The apertures are designed to penetrate through the aperture electrode. By providing a plurality of small apertures, the toner can be highly controlled with low voltage. Therefore, an image can be formed with high image quality and at a high speed.

15 Claims, 5 Drawing Sheets

IMAGE FORMING APPARATUS WITH AN ELECTRODE UNIT HAVING PLURAL ELECTRODES

BACKGROUND OF THE INVENTION

1. Field of the Invention

This invention relates to an image forming apparatus with an electrode unit having plural apertures for use in a reproduction device such as a copying machine, a printer, a plotter, or a facsimile machine.

2. Description of Related Art

Known image forming apparatus in which an image is formed use a toner flow control means having plural apertures. In such an image forming apparatus, a voltage is selectively applied to the toner flow control means in accordance with image data to control toner particles to selectively pass through the apertures. The toner particles that pass through the apertures of the toner flow control means form an image on an image forming medium (supporter). This type of image forming apparatus is disclosed in U.S. Pat. No. 3,689,935, for example.

However, in this apparatus, each aperture is controlled by one control electrode. Therefore, the amount of toner that is controlled by each control electrode is limited by the aperture area. Increasing the aperture size would increase the amount of the toner to be passed through the apertures. However, the control electric field formed by a control voltage to be applied to the control electrodes would be extremely small in the vicinity of the center of the apertures. This would cause reduction in recording density and attachment of the toner to those portions at which the image is not required to be formed. Therefore, such an apparatus would have poor control performance for the toner flow.

SUMMARY OF THE INVENTION

An object of this invention is to provide a high-quality image forming apparatus in which an image can be formed at high recording density and without attachment of toner to those portions at which image formation is not required.

To attain the above and other objects, the image forming apparatus according to embodiments of this invention includes toner flow control means having plural apertures and control electrodes, each of which is provided around each of the apertures, wherein the aperture allocated to each control electrode of the toner flow control means is divided into plural segments.

According to the image forming apparatus of this invention, a large control electric field can be formed inside of the multi-segmented aperture of the toner flow control means with a low control voltage, so that the control performance of the toner flow can be improved. Further, since the aperture is divided into plural segments, the amount of the toner to be passed through the aperture is increased, and image formation can be performed at high density and with high image quality.

As is apparent from the foregoing, according to the image forming apparatus of this invention, high control performance of the toner flow can be achieved by providing small apertures, and the control of the toner flow can be performed with a low control voltage. Further, since a large number of small apertures are provided, a large amount of toner can be passed through the apertures, and thus the image recording can be performed at high density, with high image quality and at high speed.

BRIEF DESCRIPTION OF THE DRAWINGS

Preferred embodiments of the present invention are described in detail with reference to the following figures wherein.

DETAILED DESCRIPTION OF PREFERRED EMBODIMENTS

Preferred embodiments according to this invention are described hereunder with reference to the accompanying drawings.

The construction of an image forming apparatus having an aperture electrode member, referred to as an aperture electrode 1 herein, is first described with reference to FIGS. 1 to 3.

Figure 1:
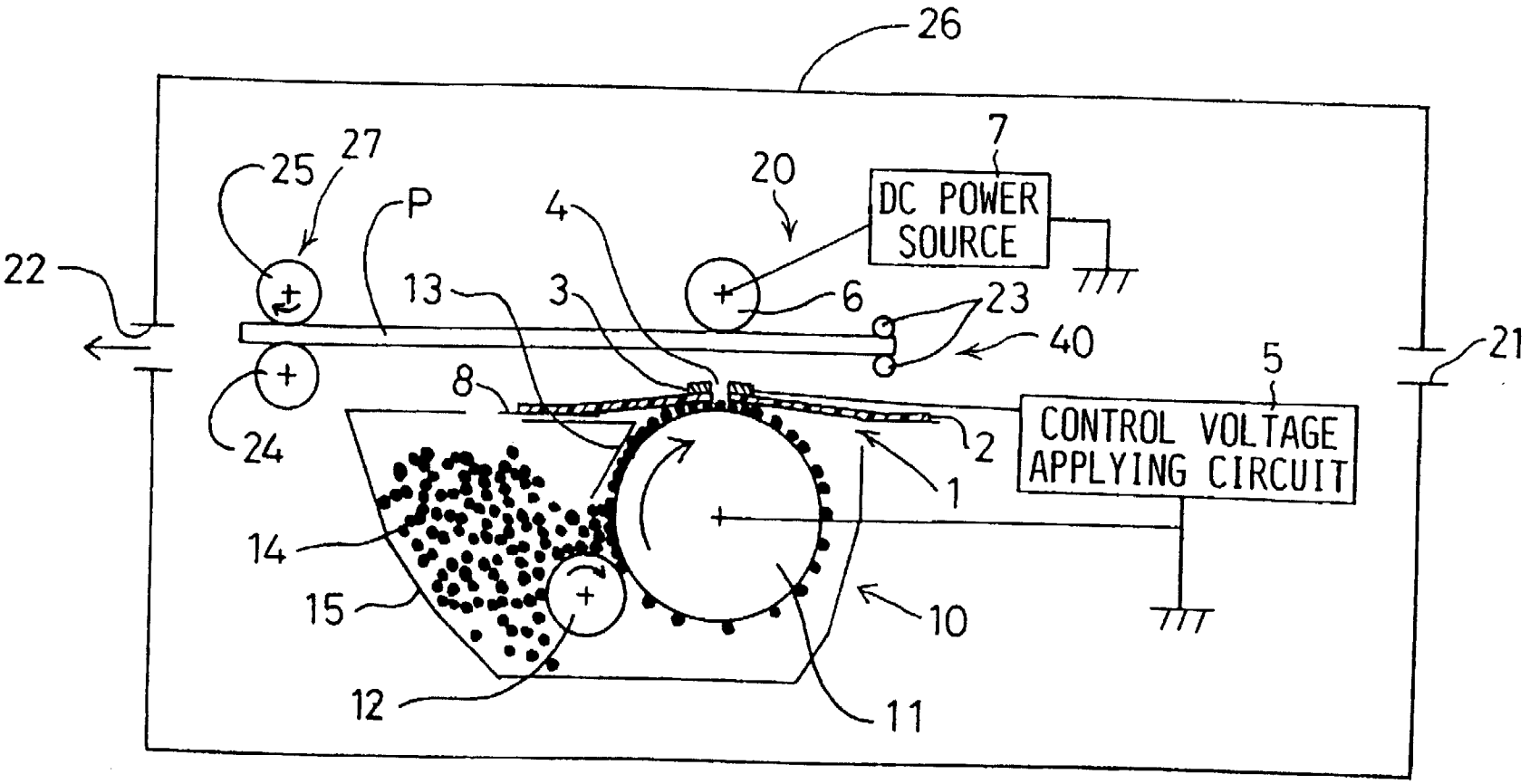
FIG. 1 is a schematic view showing an embodiment of an image forming apparatus according to this invention.

As shown in FIG. 1, an insertion port 21 through which a supporter P is inserted is provided at the right side surface of a housing 26 of the image forming apparatus, and a discharge port 22 through which the supporter P having an image formed thereon is discharged is provided at the left side surface of the housing 26. The inside body of the housing 26 of the image forming apparatus mainly comprises a toner supply portion 10, a toner control portion 20, and a supporter feeding portion 40.

The toner supply portion 10 comprises a toner case 15 serving as a housing for the whole toner supply portion 10, toner 14 stocked in the toner case 15, a toner supply roller 12, a toner carry roller 11 and a toner-layer restricting blade 13.

The toner supply roller 12 is disposed inside of the toner case 15 to be rotatable in a direction as indicated by an arrow in FIG. 1. Through frictional contact with the toner 14 in the toner case 15, the toner supply roller 12 charges the toner 14 negatively, and attracts the charged toner 14 to the surface thereof.

The toner carry roller 11 is also disposed in the toner case 15 to be rotatable in a direction as indicated by an arrow and is disposed in contact with and in parallel to the toner supply roller 12. Accordingly, the toner carry roller 11 frictionally contacts the charged toner 14, which is fed while attached to the surface of the toner supply roller 12, and further charges the toner 14 negatively. The toner carry roller 11 further attracts the charged toner to the surface thereof to carry it thereon. Then, the toner 14 is fed toward the aperture electrode 1. The toner carry roller 11 is grounded.

The toner-layer restricting blade 13 is disposed in contact with the toner carry roller 11 under pressure and adjusts the amount of the toner 14 carried on the surface of the toner carry roller 11 to be uniform on the roller surface and to thereby be uniformly charged.

The toner control portion 20 includes an aperture electrode 1, a control voltage applying circuit 5, a back electrode roller 6 and a DC power source 7.

Figure 2:
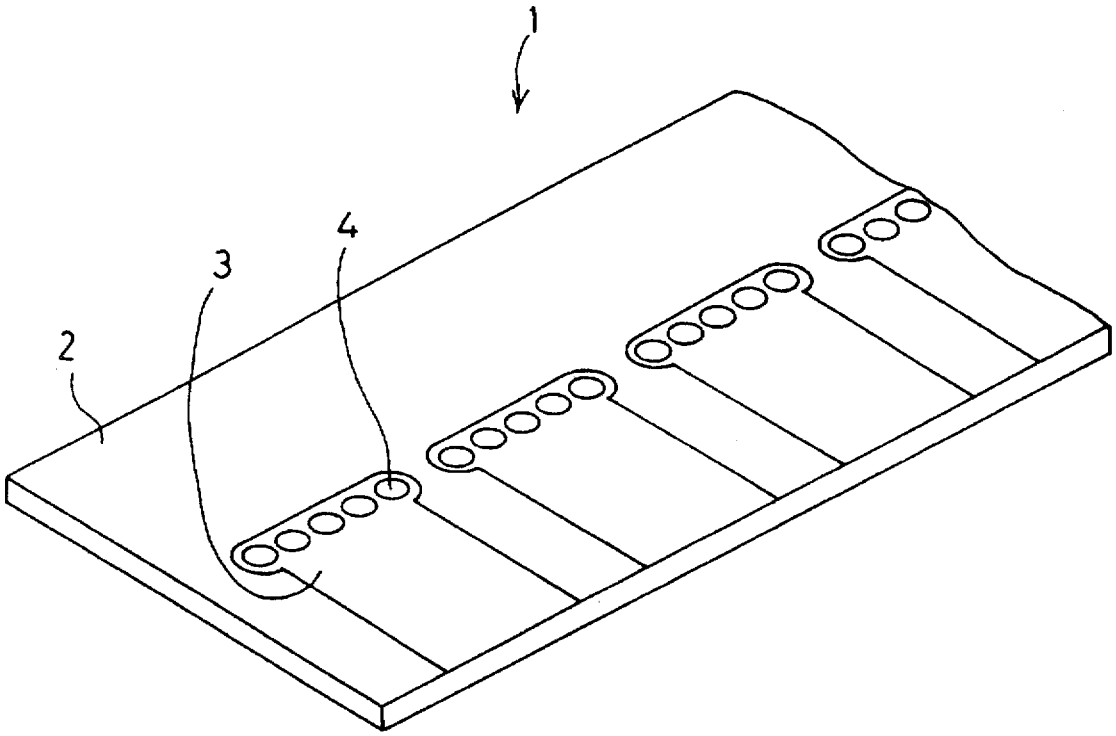
FIG. 2 is a perspective view showing the construction of an aperture electrode used in the image forming apparatus of this invention.
Figure 3:
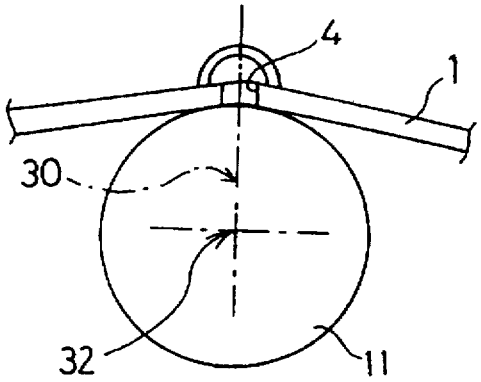
FIG. 3 is a schematic diagram showing the construction of an aperture electrode and a toner carry roller used in the image forming apparatus of this invention.

As shown in FIG. 2, the aperture electrode 1 comprises a polyimide insulating sheet 2 of preferably 25 μm thickness, control electrodes 3 of preferably 1 μm thickness formed on the upper surface of the insulating sheet 2, and a segmented aperture area having five circular apertures or sub-apertures of preferably 40 μm diameter formed in each control electrode 3. Further, the five apertures 4 are aligned in a row in the longitudinal direction of the aperture electrode 1 and penetrate through the aperture electrode 1. The aperture electrode 1 is disposed so that the apertures 4 of the insulating sheet 2 are pressed against the toner carry roller 11 while the control electrodes 3 confront the fed supporter P side.

The detailed positional relationship between the apertures 4 of the aperture electrode 1 and the toner carry roller 11 is described with reference to FIG. 3. Each of the apertures 4 of the aperture electrode 1 is disposed so that the center axis 30 of each aperture 4 passes over the uppermost portion of the periphery of the toner carry roller 11 and the center axis 32 of the toner carry roller 11. Accordingly, each of the apertures 4 is disposed to be symmetrically at right and left sides with respect to the uppermost portion of the periphery of the toner carry roller 11, whereby the toner 14 passing through each aperture 4 can be uniformly distributed over the whole area of the aperture 4. Further, since the wall surface of the aperture 4 and the toner flow direction are parallel to each other, the toner 14 can stably flow through the aperture 4. In addition, the aperture electrode 1 itself is pressed against the toner carry roller 11 such that it can be substantially equiangularly bent to the right and left sides of the apertures 4 around the aperture array. With this construction, the contact area between the aperture electrode 1 and the toner carry roller 11 can be increased. In addition, those portions surrounding the peripheries at the lower side of the apertures 4 can be pressed uniformly at the right and left sides, so that non-uniformity in recording density, which would occur when an image is formed, can be substantially prevented.

The control voltage applying circuit 5 is connected to the control electrodes 3 of the aperture electrode 1 and the toner carry roller 11. It serves to selectively apply a voltage of −30 V or +10 V to the control electrodes 3 based on the image data input from a data input portion, not shown in the figures. As described above, the toner carry roller 11 is grounded.

The cylindrical back electrode roller 6 is disposed to face the toner carry roller 11 through the apertures 4 of the aperture electrode 1. The back electrode roller 6 is disposed away from the aperture electrodes 1 substantially at a 0.5 mm interval and is rotatably supported by a chassis (not shown). Therefore, the apparatus is designed so that the supporter P is insertable into a gap between the back electrode roller 6 and the aperture electrode 1. The DC power source 7 is connected to the back electrode roller 6 and applies a voltage of +1 kV to the back electrode roller 6.

The supporter feeding portion 40 includes a pair of feeding rollers 23, the back electrode roller 6 and a fixing device 27. The supporter P, which is fed through the insertion port 21 of the housing 26, is pinched by the pair of feeding rollers 23, passes over a locating position of the back electrode roller 6, which serves as an image forming position, and is then fed to the fixing device 27. The fixing device 27 comprises a heat roller 25 having a heat source therein, and a press roller 24, which is pressed against the heat roller 25. The supporter P having an image formed thereon is pinched by the two rollers 24 and 25 in the fixing device 27. The toner image is thermally fixed and is thereafter discharged from the image forming apparatus through the discharge port 22.

Next, the operation of the image forming apparatus according to this embodiment is described with reference to FIGS. 1 and 2.

Upon input of an instruction for forming an image to the image forming apparatus, the toner carry roller 11 and the toner supply roller 12 first start their rotation in the direction as indicated by the arrows in FIGS. 1. Through this rotational motion of these rollers, the toner 14 fed from the toner supply roller 12 is rubbed against the surface of the toner carry roller 11 to be negatively charged and then carried on the surface of the toner carry roller 11. The toner 14 thus carried is thinned and uniformly charged by the toner-layer restricting blade 13. Then, the toner 14 is fed toward the aperture electrode 1 through the rotation of the toner carry roller 11. The toner 14 on the toner carry roller 11 is supplied to the lower side of the apertures 4 while being rubbed against the insulating sheet 2 of the aperture electrode 1.

At this time, those control electrodes 3 that correspond to an image-forming area are supplied with a voltage of +10 V in accordance with an input image signal by the control voltage applying circuit 5. Consequently, an electric line of force is generated in the vicinity of the apertures 4 at the image-forming area due to potential difference between the control electrode 3 and the toner carry roller 11. By this electric line of force, the negatively charged toner 14 is electrostatically attracted to a higher potential position so that it is attracted from the surface of the toner carry roller 14 through the apertures 4 to the side of the control electrodes 3. The toner 14, which has reached the control electrodes side, is further electrostatically attracted toward the supporter P by an electric field formed between the supporter P and the aperture electrodes 1 due to the voltage applied to the back electrode roller 6. It is then deposited on the supporter P, thereby forming an image on the supporter P.

The control electrodes 3 corresponding to a no-image forming area is supplied with a voltage of −30 V from the control voltage applying circuit 5. As a result, an electric line of force extending from the toner carry roller 11 to the control electrodes 3 is formed in the vicinity of the apertures 4 corresponding to the image forming area due to the potential difference between the control electrodes 3 and the toner carry roller 11. The negatively charged toner 14 is electrostatically attracted to a higher potential position by the electric line of force. Thus, the toner 14 on the toner carry roller 11 is not passed through the apertures 4.

The supporter P is fed in a direction perpendicular to the aperture array by a distance corresponding to one picture element by the supporter feeding portion 40 while one array of picture elements is formed on the surface of the supporter P with the toner 14. Through the repetitive operation as described above, a toner image is formed on the whole surface of the supporter P. Then, the formed toner image is fixed on the supporter P by the fixing device 27. Finally, the supporter P having the toner image formed thereon is discharged through the discharge port 22 to the outside of the image forming apparatus.

If insulating toner is used as the toner 14 in the image forming apparatus as described above, electrical insulation is substantially perfectly kept between the toner carry roller 11 and the control electrodes 3. Thus, there is no possibility that the apertures 4 would be broken down.

In the above process, the control electric field of the control electrodes 3 is formed inside of the control electrodes 3 and the apertures 4 and in the gap between the apertures 4 and the toner carry surface of the toner carry roller 11 that faces the apertures 4. Accordingly, the control electric field can be directly applied to the carried toner 14. Thus, a control efficiency of the toner flow is very high.

Further, even when a part of the supplied toner 14 invades into the apertures 4 corresponding to the non-image forming area due to a mechanical force applied to the toner 14 through the rubbing between the toner 14 and the aperture electrode 1, the toner 14 can be controlled not to pass through the apertures 4 by the electric field inside of the apertures 4. So, the control of the toner flow can be excellently performed.

Still further, since the toner carry roller 11 and the aperture electrode 1 confront each other through the toner layer, these elements can be disposed at a relatively short distance. Thus, the control voltage can be lowered and an inexpensive driving element can be used.

Since the insulating sheet 2 of the aperture electrode 1 is disposed to face the toner carry roller 11, the control electrodes 3 and the toner carry roller 11 are prevented from being electrically short-circuited through their contact. Thus, the driving element can be prevented from being broken down.

Further, the aperture electrode 1 and the toner carry roller 11 contact each other at the entrance portions of the apertures 4. Thus, the toner 11 deposited at the entrance portions of the apertures 4 is pushed out by the toner 14 successively supplied by the toner carry roller 11. So, the apertures 4 can be prevented from being clogged due to deposition and bridging of the toner 14 at the entrance portions of the apertures 4.

Figure 4:
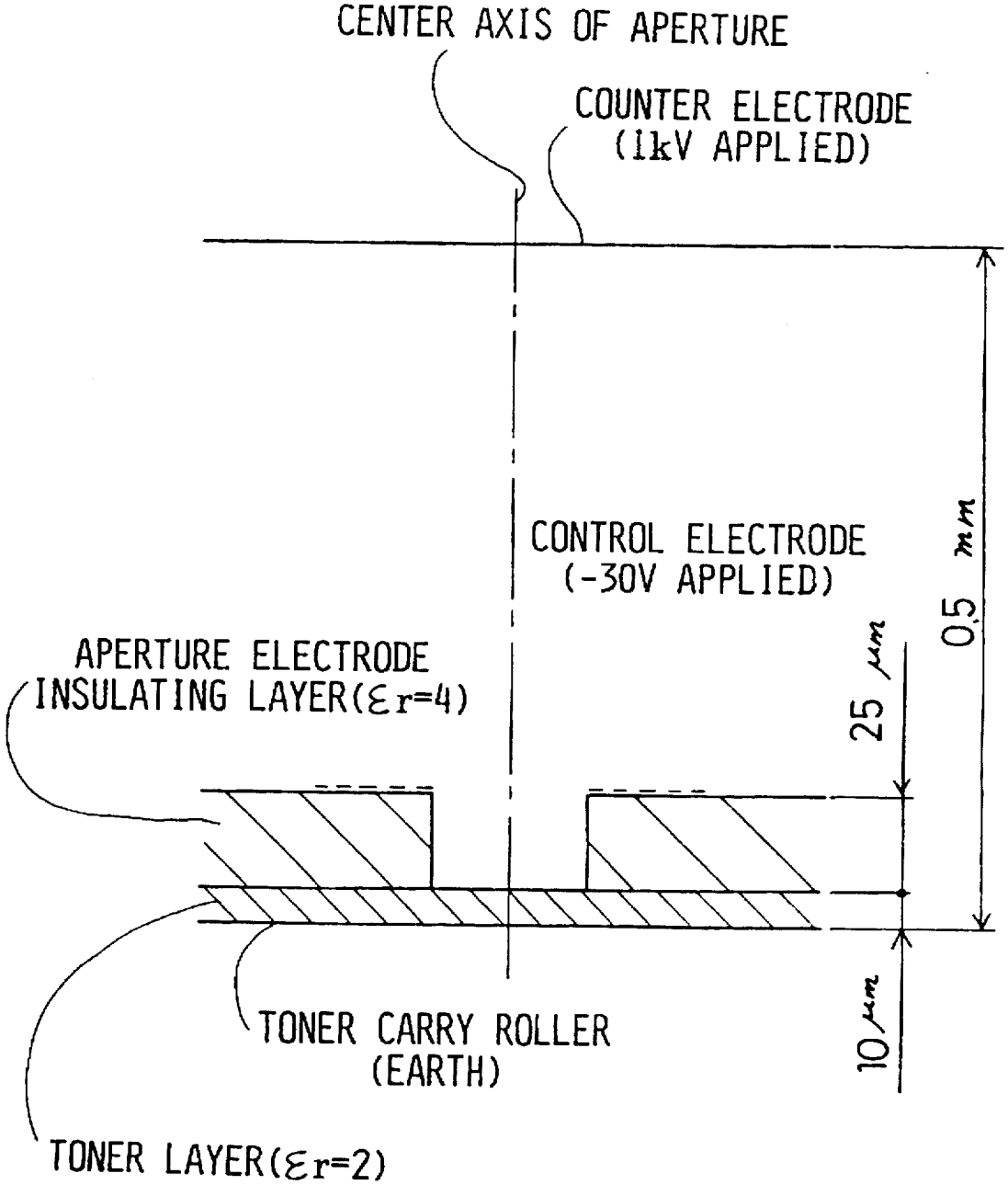
FIG. 4 is a model diagram for an electric simulation to show an operation of the image forming apparatus of this invention.
Figure 5:
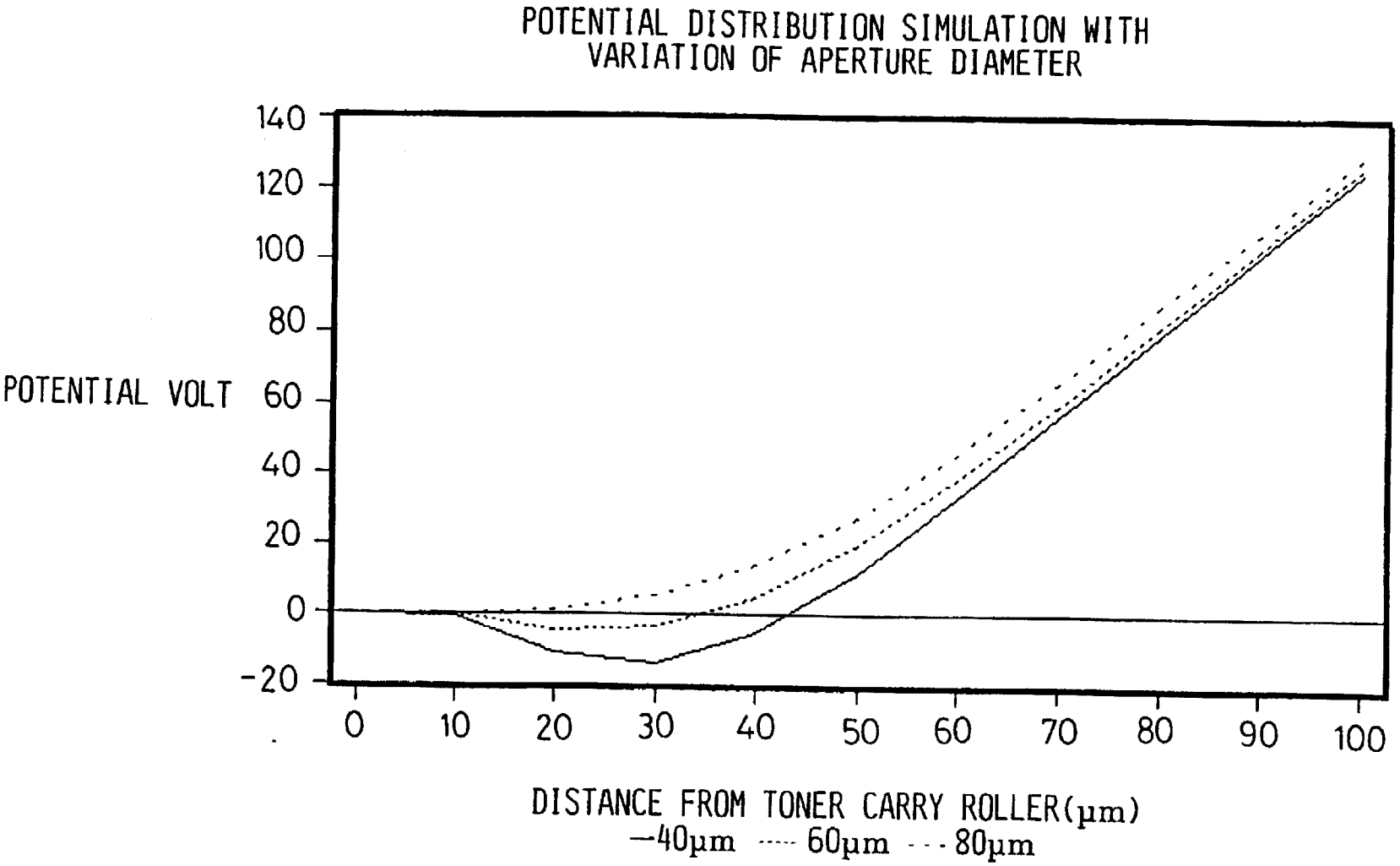
FIG. 5 is a graph showing a result of the electric simulation to show the operation of the image forming apparatus of this invention.

Next, the effect of the aperture electrode 1 according to the first embodiment is described on the basis of a result of electric field simulation by a finite element method with reference to FIGS. 4 to 5.

In FIG. 4, the toner carry roller 11 is supplied with 0 V (grounded), and a toner layer of 10 μm exists on the surface of the toner carry roller 11. The aperture electrode 1 is disposed above the toner layer. The toner layer has relative dielectric constant of 2, and the insulating layer of the aperture electrode 1 has relative dielectric constant of 4. The control electrodes 3 of the aperture electrode 1 are supplied with −30 V as a toner shielding voltage for shielding toner flow. A counter electrode (back electrode roller 6) is provided above the toner carry roller 11 at 0.5 mm interval, and +1 kV is applied to the counter electrode. Under such conditions, variation in potential distribution on the center axis of the apertures is examined for a case where the diameter of the apertures 4 is varied from 40 μm, 60 μm to 80 μm.

FIG. 5 shows a potential curve showing the simulation result. The abscissa of the potential curve represents the distance from the toner carry roller 11, and the ordinate thereof represents the potential at the center axis of the apertures. The slope of the potential curve represents the intensity of electric field, and the intensity of the electric field is higher as the slope is increased. The slope of the potential curve also represents the direction of the electric field. Therefore, the strength of a force to be applied to the toner and the direction of the force can be estimated.

According to FIG. 5, it is understood that the slope of the potential curve is uniformly positive inside of the apertures for the aperture diameter of 80 μm, and, thus, no electric field for shielding the toner flow is generated. Further, it is also understood that the potential curve has a slightly negative slope in the vicinity of the apertures for the aperture diameter of 60 μm, and, thus, a toner-flow shielding electric field is generated. Furthermore, it is also understood that the potential curve for the apertures having a diameter of 40 μm has a distinctly negatively sloped portion, and, thus, a stronger toner-flow shielding electric field is generated. Consequently, it is understood that as the diameter of the apertures is small, a stronger toner flow shielding electric field is generated. Accordingly, the aperture electrode having the insulating sheet of 25 μm thickness should have an aperture diameter that is less than about 80 μm and not less than an average toner particle diameter of about 10 μm. Accordingly, in this embodiment, small apertures having aperture diameter of about 40 μm are provided, so that a high control performance for the toner flow can be obtained, and the control of the toner flow can be performed with a low control voltage. In addition, a large number of small apertures are provided, so that a large amount of toner can be passed through the apertures. Therefore, an image recording can be performed at high density, with high image quality and at high speed.

This invention is not limited to the embodiment as described above, and various modifications may be made without departing from the subject matter.

Figure 6:
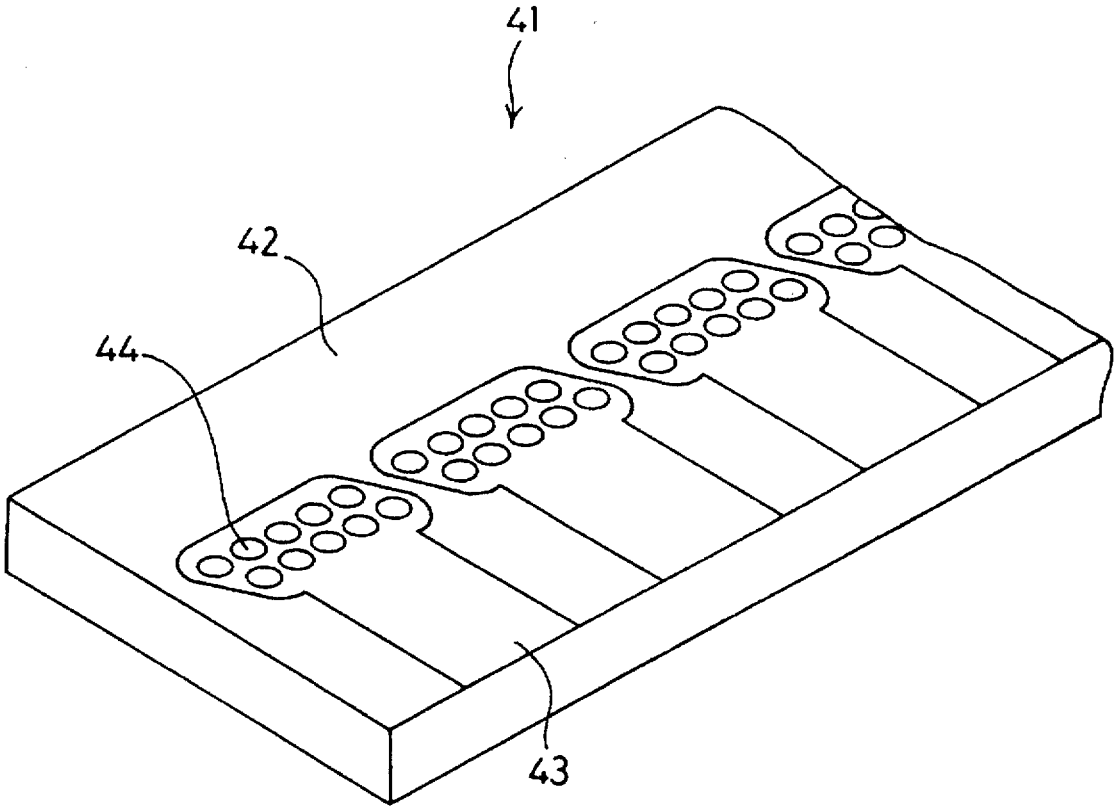
FIG. 6 is a perspective view of another embodiment of the aperture electrode.

For example, in place of the above aperture electrode, an aperture electrode 41 as shown in FIG. 6 may be used in which apertures 44 are duplicately provided in the sheet feeding direction in each control electrode 43. According to this aperture electrode 41, unevenness in toner density such as a wale streak can be prevented.

Figure 7:
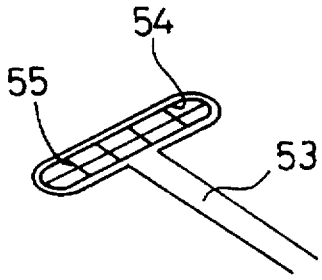
FIG. 7 is a perspective view of another embodiment of the aperture electrode.

Further, a mesh-shaped electrode 55 with a control electrode 53 and apertures 54 as shown in FIG. 7 may be provided inside of each aperture of a conventional aperture electrode to obtain the same effect.

Still further, in the above embodiment the aperture electrode is used as the toner flow control means. However, in place of this aperture electrode, a mesh-shaped electrode unit as disclosed in U.S. Pat. No. 5,036,341 may be used.

What is claimed is:

1. An image forming apparatus, comprising:

a supporter feeding assembly that feeds an image supporter in a feeding direction and defines a feed path;

a toner supply located adjacent to the feed path that supplies charged toner particles to form an image on the supporter;

a back electrode located adjacent to the feed path, facing and spaced from the toner supply, that attracts the charged toner particles from the toner supply so that an image supporter can be positioned between the toner supply and the back electrode to receive charged toner particles to form an image thereon; and a toner controller disposed adjacent to the toner supply and between the toner supply and the back electrode that controls a flow of toner particles from the toner supply to the back electrode by an application of voltage the toner controller comprising an aperture electrode member including a plurality of individual control electrodes adapted to be coupled to a voltage source, wherein each individual control electrode has a plurality of apertures therein, wherein the plurality of apertures comprises an array of aligned apertures extending in a direction transverse to the feeding direction.

2. The image forming apparatus of claim 1 wherein the plurality of apertures comprises a plurality of rows of aligned apertures, each row extending in a direction transverse to the feeding direction, wherein each row is staggered from an adjacent row so that apertures in adjacent rows are unaligned in the feeding direction.

3. The image forming apparatus of claim 1 wherein the plurality of apertures comprises a mesh having apertures therein.

4. The image forming apparatus of claim 1 wherein each of the apertures has a diameter in a range of at least 10 μm and less than 80 μm.

5. The image forming apparatus of claim 1 wherein the toner controller contacts the toner supply.

6. The image forming apparatus of claim 1 wherein the plurality of apertures comprises five apertures aligned in a row transverse to the feeding direction.

7. An image forming apparatus for forming an image on a supporter transported in a feeding direction, comprising:

toner supply means for supplying charged toner particles to form an image on a supporter;

back electrode means for attracting the charged toner particles from the toner supply means disposed facing and spaced from the toner supply means so that an image supporter can be positioned therebetween for receiving the charged particles in an image; and toner control means for controlling a flow of charged toner particles from the toner supply means to the back electrode means by an application of voltage, disposed between the toner supply means and the back electrode means, the toner control means comprising an aperture electrode member including a plurality of individual control electrodes adapted to be coupled to a voltage source, each individual control electrode having a segmented aperture area therein forming a plurality of apertures aligned in a direction transverse to the feeding direction.

8. The image forming apparatus of claim 7 wherein each of the plurality of apertures has a diameter in a range of at least 10 μm and less than 80 μm.

9. The image forming apparatus of claim 7 wherein each segmented aperture area is formed from a mesh.

10. The image forming apparatus of claim 7 wherein each segmented aperture area comprises plural apertures aligned in plural rows, each row transverse to the feeding direction.

11. The image forming apparatus of claim 10 wherein the apertures in adjacent rows are unaligned.

12. An electrode member for controlling a flow of charged particles therethrough comprising:

an insulating layer having an outer edge and a surface and a plurality of apertures formed therein, the apertures being arranged in groups; and a plurality of control electrodes provided on the surface of the insulating layer extending inwardly in a transverse direction from the outer edge and arranged to be electrically insulated from one another, each control electrode surrounding one group of apertures, wherein each group of apertures comprises at least one row of aligned apertures generally parallel to the outer edge.

13. The electrode member of claim 12 wherein each group of apertures is formed by a mesh.

14. The electrode member of claim 12 wherein each group of apertures comprises a plurality of rows of aligned apertures, wherein each row is staggered from an adjacent row so that apertures in adjacent rows are unaligned.

15. The electrode member of claim 12 wherein each of the apertures has a diameter in a range of at least 10 μm and less than 80 μm.

* * * * *